United States Patent [19]

Bailey

[11] Patent Number: 4,854,369

[45] Date of Patent: Aug. 8, 1989

[54] APPARATUS FOR SURROUNDING A FOAM PATTERN CLUSTER WITH SAND

[75] Inventor: Francis V. Bailey, Racine, Wis.

[73] Assignee: Outboard Marine Corporation, Waukegan, Ill.

[21] Appl. No.: 303,976

[22] Filed: Jan. 30, 1989

Related U.S. Application Data

[63] Continuation of Ser. No. 171,575, Mar. 22, 1988, abandoned.

[51] Int. Cl.[4] ..... B22C 5/12; B22C 9/04

[52] U.S. Cl. ..... 164/159; 164/34; 164/192

[58] Field of Search ..... 164/159, 192, 34, 35, 164/36, 237, 246, 160.1, 160.2

[56] References Cited

U.S. PATENT DOCUMENTS

| | | | |
|---|---|---|---|
| 4,565,227 | 1/1986 | Shebuski | 141/1 |
| 4,566,520 | 1/1986 | Shebuski | 164/131 |
| 4,593,739 | 6/1986 | VanRens et al. | 164/192 X |
| 4,598,757 | 7/1986 | Bailey | 164/137 |
| 4,766,942 | 8/1988 | Wessman et al. | 164/34 |

*Primary Examiner*—Nicholas P. Godici
*Assistant Examiner*—J. Reed Batten, Jr.
*Attorney, Agent, or Firm*—Michael, Best & Friedrich

[57] ABSTRACT

An apparatus for surrounding a mold pattern in a mold flask with sand, the apparatus comprising a plurality of generally vertically extending tubes, a mechanism for securing the pattern to the tubes to form a tube and pattern assembly, a mechanism for lowering the assembly into the flask, a mechanism for depositing sand through the tubes and into the flask, and a mechanism for raising the tubes relative to the flask and to the pattern.

26 Claims, 7 Drawing Sheets

10
14
16
18
20
22
26
30
34
40
48
50
52
60

10
14
16
18
20
22
26
30
40
48
50
52
60

6
10
12
14
16
18
20
22
24
26
30
34
35
36
38
40
42
48
50
52
60

APPARATUS FOR SURROUNDING A FOAM PATTERN CLUSTER WITH SAND

This is a continuation of Ser. No. 171,575, filed Mar. 22, 1988 and now abandoned.

BACKGROUND OF THE INVENTION

The invention relates to lost foam casting, and more particularly to processes and apparatus for surrounding foam mold patterns with sand.

Shebuski U.S. Pat. No. 4,565,227, which issued Jan. 21, 1986 and which is incorporated herein by reference, discloses a process and apparatus for surrounding a hollow mold pattern with sand. The apparatus includes tubes located outside the pattern, a tube located inside the pattern, means for releasing sand into the top ends of the tubes, and means for raising the tubes.

Attention is also directed to U.S. Pat. Nos. 4,598,757 and 4,566,520, which are assigned to the assignee hereof.

SUMMARY OF THE INVENTION

The invention provides an apparatus for surrounding a mold pattern with sand in a mold flask, the apparatus comprising a plurality of generally vertically extending tubes, means for securing the pattern to the tubes to form a tube and pattern assembly, means for causing relative movement of the assembly and the flask so that the assembly is located in the flask, and means for depositing sand through the tubes and into the flask.

In one embodiment, the means for causing relative movement of the assembly and the flask includes means for moving the assembly relative to the flask.

In one embodiment, the means for moving the assembly includes means for lowering the assembly into the flask.

In one embodiment, the tubes have respective lower ends, and the apparatus further comprises means for raising the lower ends of the tubes.

In one embodiment, the apparatus further comprises means for releasing the securing means, and means for raising the tubes relative to the flask and to the pattern.

In one embodiment, the pattern includes a portion located beneath one of the tubes, and the apparatus further comprises means for deflecting sand around the pattern portion.

The invention also provides an apparatus for surrounding a mold pattern cluster with sand in a mold flask, the cluster including a plurality of sleeve patterns, the apparatus comprising a plurality of generally vertically extending tubes, means for supporting the cluster in the flask, means for supporting the tubes in and among the cluster so that each sleeve pattern has located therein a respective tube, and means for depositing sand through the tubes and into the flask.

The invention also provides an apparatus for surrounding a mold pattern cluster with sand in a mold flask, the cluster including a plurality of sleeve patterns, the apparatus comprising a plurality of generally vertically extending tubes, means for securing the cluster to the tubes to form a tube and cluster assembly, and for supporting the tubes in and among the cluster so that each sleeve pattern has located therein a respective tube, means for causing relative movement of the assembly and the flask so that the assembly is located in the flask, and means for depositing sand through the tubes and into the flask.

A principal feature of the invention is the provision of an apparatus comprising means for securing a pattern to a plurality of tubes to form a tube and pattern assembly, means for lowering the assembly into a mold flask, means for depositing sand through the tubes and into the mold flask, means for releasing the securing means, and means for raising the tubes relative to the mold flask and to the pattern.

Another principal feature of the invention is the provision of an apparatus comprising means for supporting a cluster of cylinder sleeve foam patterns in a mold flask, means for supporting a plurality of tubes in and among the cluster so that a tube is located inside each sleeve pattern and so that the lower ends of the tubes are located substantially in a horizontal plane, and means for depositing sand through the tubes and into the mold flask.

Other features and advantages of the invention will become apparent to those skilled in the art upon review of the following detailed description, claims and drawings.

Figure 1:
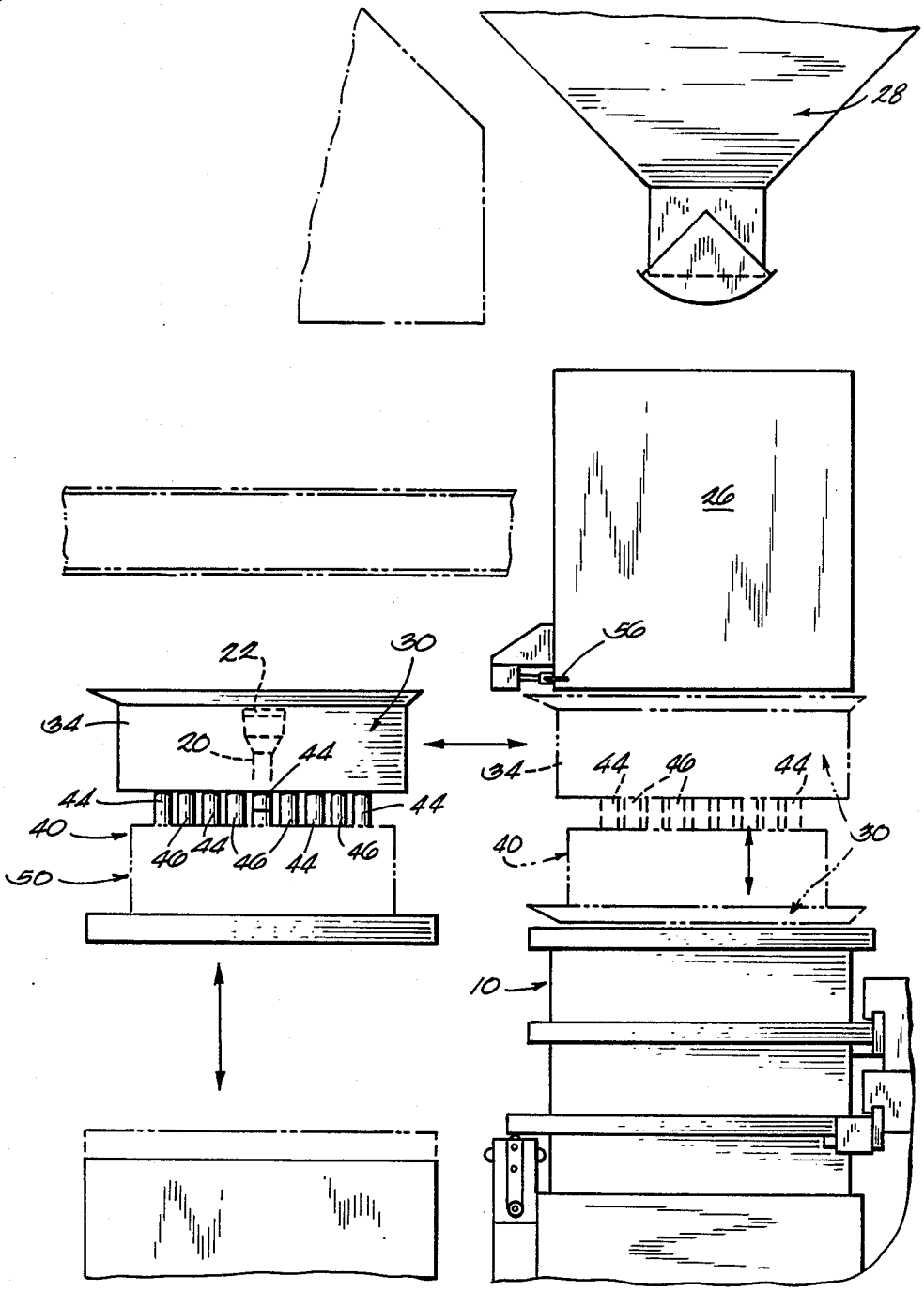
FIG. 1 is a side elevational view, partially in section, of an apparatus embodying the invention.
Figure 4:
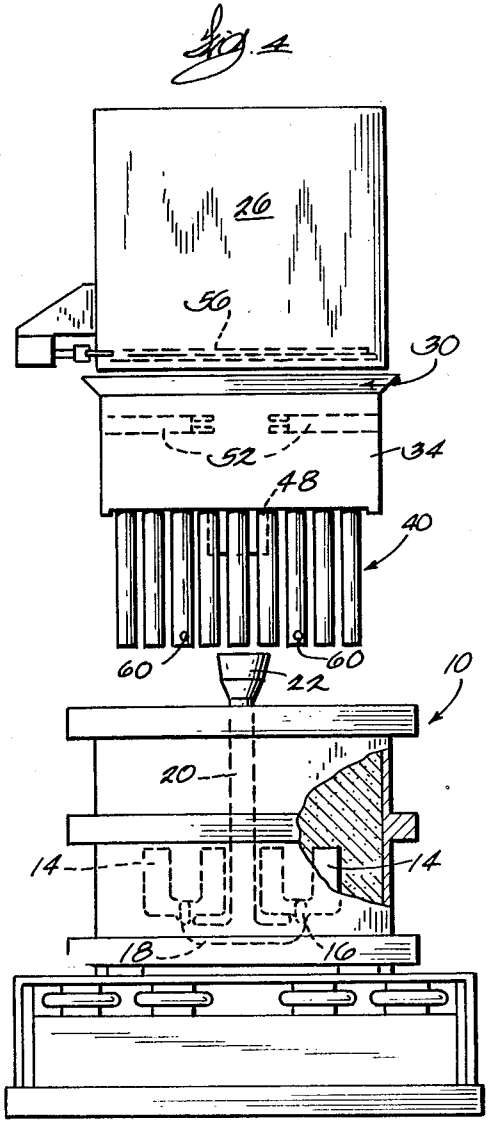
FIG. 4 is a view similar to FIG. 3 and showing the pattern released from the shuttle assembly and the hopper and shuttle assembly being raised from the flask.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein are for the purpose of description and should not be regarded as limiting.

DESCRIPTION OF THE PREFERRED EMBODIMENT

Illustrated in the drawings are a mold flask 10 and a foam pattern cluster 12 to be used in a lost foam casting process. The cluster 12 includes a plurality of two-cycle or ported cylinder sleeve foam patterns 14 supported and interconnected by runners 16 and 18. Preferably, the cluster 12 includes sixteen sleeve patterns 14, with first, second, third and fourth rows of four patterns each. A sprue 20 is connected to the runner 18. In the preferred embodiment, the sprue 20 is made of bonded sand, although the sprue can be made of other suitable materials, such as foam. The upper end of the sprue 20 has thereon a sprue cup 22. Such a sprue cup 22 is disclosed in Bailey U.S. Pat. No. 4,598,757, which issued July 8, 1986 and which is incorporated herein by reference.

Also shown in the drawings is an apparatus 24 for surrounding the pattern cluster 12 with sand. The apparatus 24 comprises a source of sand. Preferably, the source includes a batch hopper 26 positioned above the mold flask 10, and a main hopper 28 positioned above the batch hopper 26. The apparatus 24 also comprises a shuttle assembly 30 supported for reciprocal horizontal movement (see FIG. 1) between a first or right position wherein the shuttle assembly 30 is positioned beneath the batch hopper 26, and a second or left position wherein the shuttle assembly 30 is laterally displaced relative to the batch hopper 26 and mold flask 10. When the shuttle assembly 30 is in the second or left position, the shuttle assembly 30 is also vertically and reciprocally moveable between raised and lowered positions. The shuttle assembly 30 includes a frame 32, and a housing or skirt 34 depending from the frame 32. The skirt 34 defines an interior chamber 35. The lower end of the skirt 34 has thereon an inwardly extending lip 36, and the shuttle assembly 30 also includes a tube plate 38 supported by the lip 36.

Figure 5:
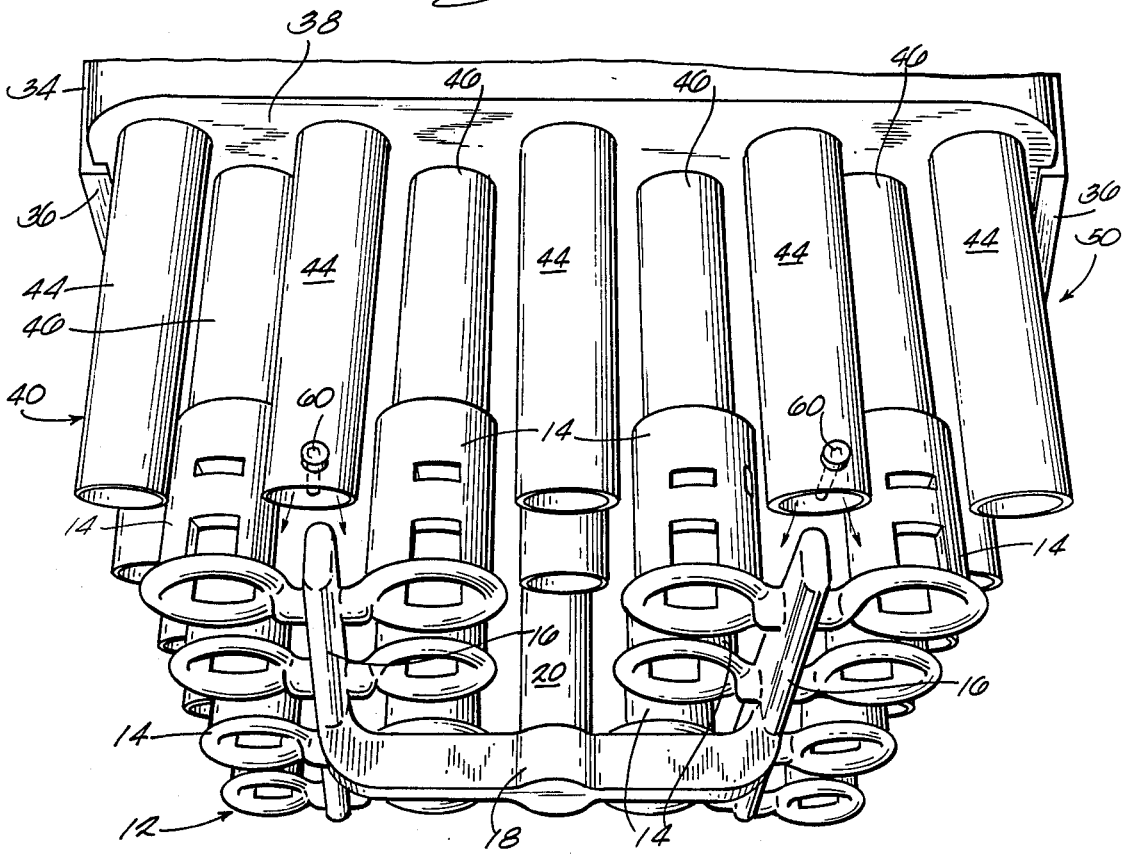
FIG. 5 is a perspective view of the bottom of the pattern and tubes.

The apparatus 24 also comprises a plurality of generally vertically extending tubes 40 having respective upper and lower ends. The upper ends of the tubes 40 are supported by and extend through the tube plate 38, so that the tubes 40 are open to the chamber 35 defined by the skirt 34. The lower ends of the tubes 40 are located substantially in a horizontal plane 42. Preferably, the tubes are arranged in nine staggered rows. The first, third, seventh, and ninth rows (counting from left to right in FIG. 5), have therein five tubes 44, the fifth row has therein four tubes 44, and the second, fourth, sixth, and eighth have therein four tubes 46. Except for the center tube 48 in the fifth row, all of the tubes 40 are substantially the same size and are equidistant from adjacent tubes. The center tube 48 of the fifth row is substantially larger than the other tubes, for reasons explained hereinafter.

Figure 6:
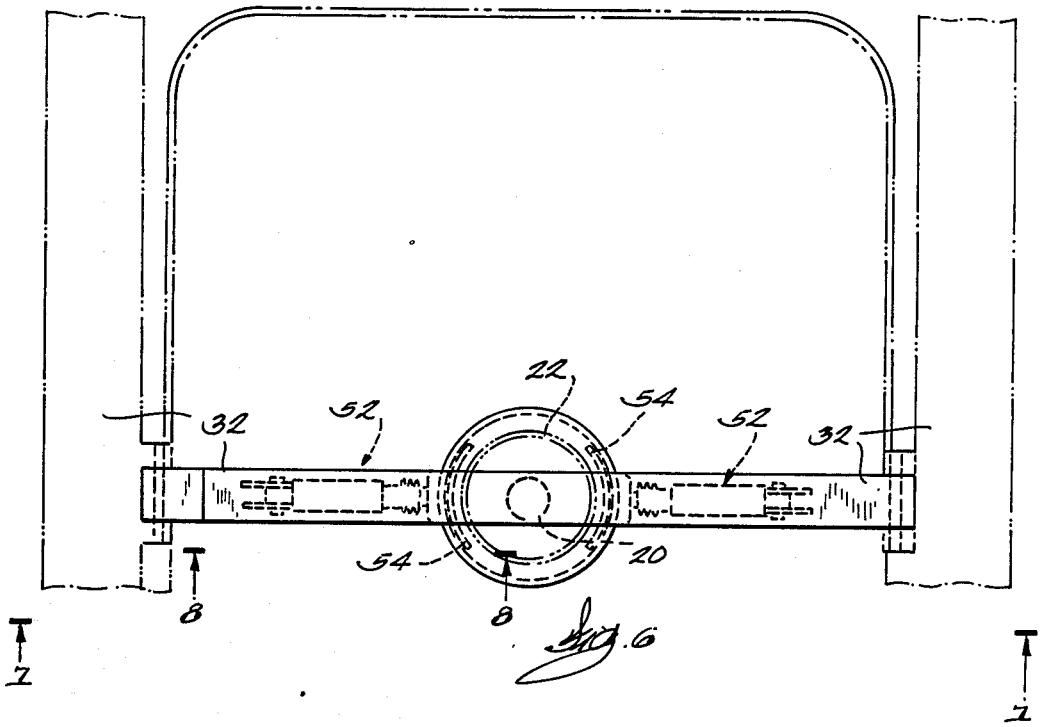
FIG. 6 is a view taken along line 6—6 in FIG. 2.
Figure 7:
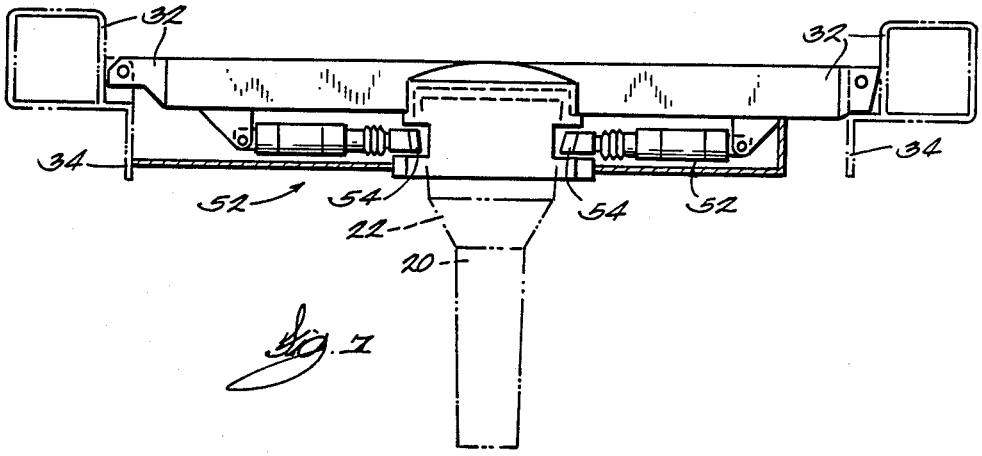
FIG. 7 is a view taken along line 7—7 in FIG. 6.
Figure 8:
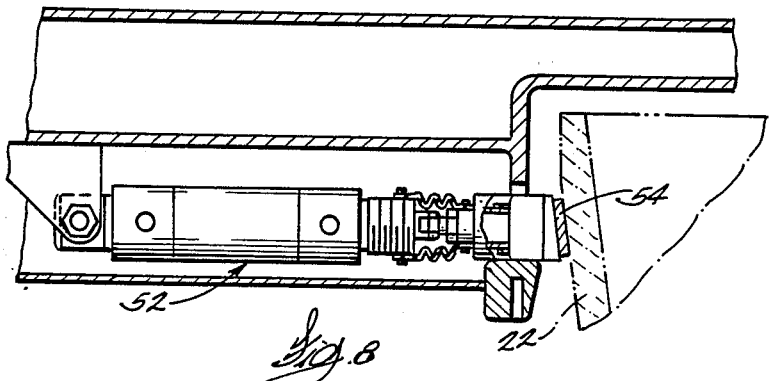
FIG. 8 is a view taken along line 8—8 in FIG. 6.
Figure 9:
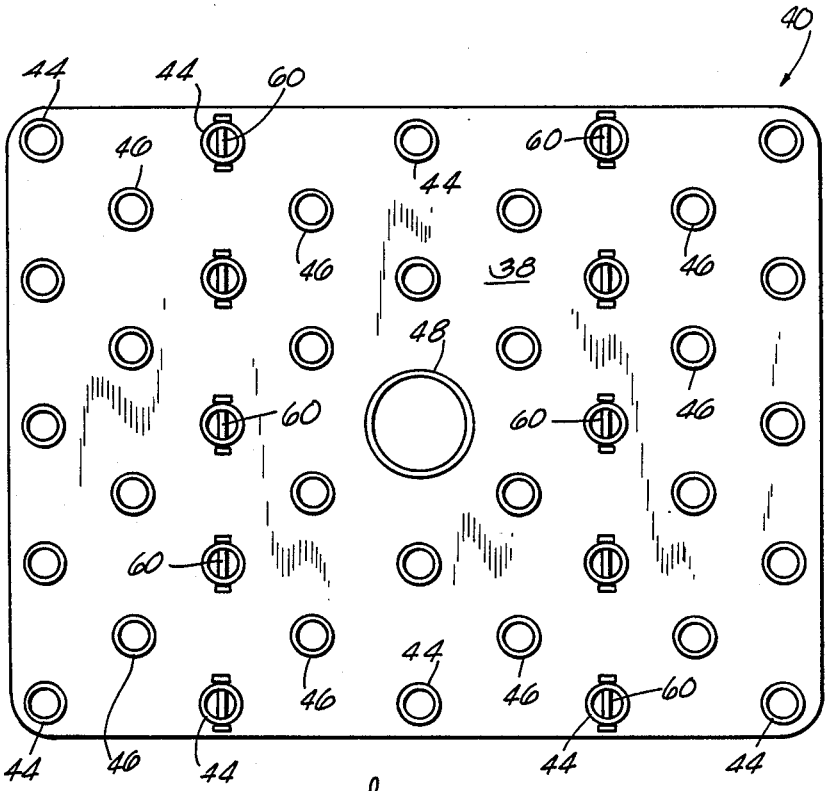
FIG. 9 is a bottom plan view of the tubes.

The apparatus 24 also comprises means for securing the cluster 12 to the tubes 40 to form a tube and cluster assembly 50, and for supporting the tubes in and among the cluster 12 so that each sleeve pattern 14 has located therein a respective tube 40. In the preferred embodiment, the tubes 40 extend approximately 75% of the length of the patterns 14 into the patterns. Preferably, each sleeve pattern of the first row of sleeve patterns has therein a respective tube from the second row of tubes, each sleeve pattern in the second row of sleeve patterns has therein a respective tube 46 from the fourth row of tubes, each sleeve pattern 14 in the third row of sleeve patterns has therein a respective tube 46 from the sixth row of tubes, and each sleeve pattern in the fourth row of sleeve patterns has therein a respective tube from the eighth row of tubes. While various suitable securing and supporting means can be employed, in the preferred embodiment, such means includes means mounted on the shuttle assembly 30 for releasably engaging the sprue cup 22. As shown in FIGS. 6 through 8, this means preferably includes a pair of opposed, selectively operable gripping mechanisms 52 supported by the frame 32 and having respective arcuate clamping members 54 selectively engageable with opposite sides of the sprue cup 22. When the gripping mechanisms 52 engage the sprue cup 22, the sprue 20 extends through the center tube 48, and the remaining tubes 40 extend in and among the cluster 12 as described above. Also, the tubes and cluster form the single assembly 50.

The apparatus 24 also comprises means for causing relative movement of the assembly 50 and the flask 10 so that the assembly 50 is located in the flask 10. Preferably, such means includes means for moving the assembly relative to the flask. More particularly, such means preferably includes means for lowering the assembly into the flask. In the illustrated construction, the means for lowering the cluster and tube assembly into the flask includes the shuttle assembly 30. As shown in the drawings, a cluster is initially located on the left side of the flask 10 so that the cluster is beneath the shuttle assembly when the shuttle assembly is in the left and raised positions. When the shuttle assembly is moved to the lowered position, the center tube 48 moves down over the sprue 20 and the remaining tubes 40 move into and around the cluster. Next, the gripping mechanisms 52 are actuated to engage the sprue cup 22 and the shuttle assembly and cluster are moved to the raised position. Next, the shuttle assembly and cluster are moved to the first or right position, and the batch hopper 26, shuttle assembly 30 and cluster 12 are then lowered relative to the flask so that the tubes and cluster are located inside the flask.

Figure 3:
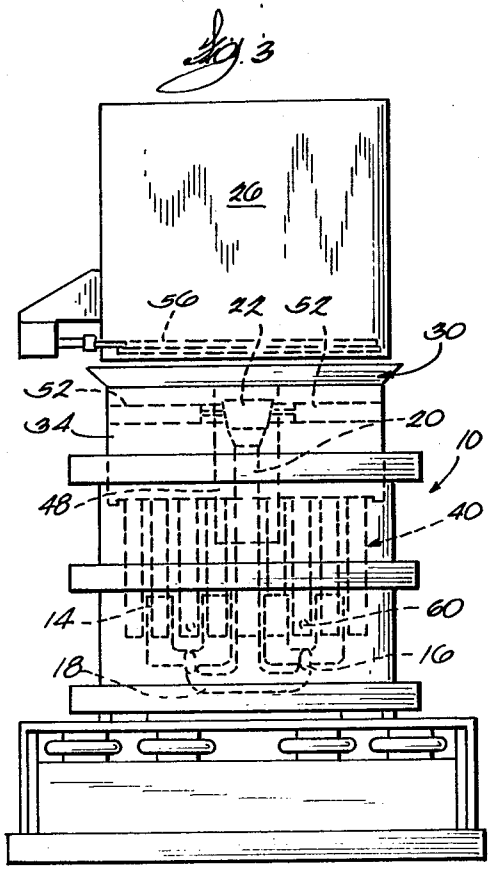
FIG. 3 is a view similar to FIG. 2 showing the hopper, shuttle assembly and pattern lowered so that the pattern is inside the flask.
Figure 2:
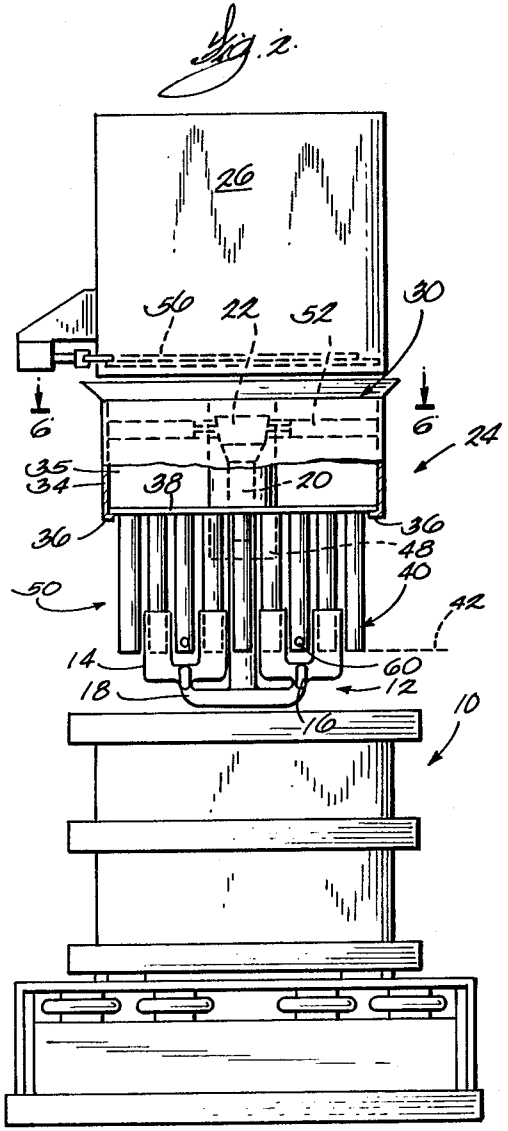
FIG. 2 is a side elevational view of the left side of the apparatus as shown in FIG. 1 and showing the pattern and shuttle assembly under the hopper.

The apparatus also comprises means for depositing sand through the tubes 40 (except the tube 48) and into the flask. In the preferred embodiment, this means includes a plurality of openings in the bottom of the batch hopper, and a sliding door 56 located adjacent the bottom of the batch hopper and having therein openings that can be aligned with the openings in the bottom of the batch hopper. The sliding door 56 is selectively moveable between an open position (FIG. 3) wherein the openings are aligned so that sand flows from the batch hopper into the chamber 35 defined by the skirt 34, and a closed position (FIG. 2) wherein the sliding door closes the openings in the bottom of the batch hopper. A similar arrangement is shown in U.S. Pat. No. 4,565,227. Because the tubes 40 are open to the chamber 35, sand flows into the tubes when the sliding door 56 is in the open position. When the chamber 35 is filled with sand, the center tube 48, which extends upwardly through the chamber 35, prevents the sand from reaching the sprue 20.

The apparatus 24 further comprises means for releasing the securing means, i.e., for releasing the gripping mechanisms 2, and means for raising the tubes 40 relative to the flask 10 and to the cluster 12. While various suitable means can be employed, in the preferred embodiment, the means for raising the tubes includes means for raising the batch hopper and the shuttle assembly. When the gripping mechanisms 52 are released and the shuttle assembly 30 is raised relative to the flask and to the cluster, the center tube 48 moves upwardly over the sprue 20 and sprue cup 22 and the remaining tubes are withdrawn from the cluster.

In the preferred embodiment, the runners 16 are located directly beneath the third and seventh rows of tubes 44 when the cluster is secured relative to the tubes. In order to prevent sand flowing through the tubes 44 from impinging directly on the runners 16 and thereby distorting or shifting the cluster, the apparatus further comprises means for deflecting sand around the runners 16. While various suitable means can be employed, in the preferred embodiment, this means includes, in the lower end of each of the tubes 44 of the third and seventh rows, a horizontally extending bolt 60.

The apparatus operates as follows. Initially, as described above, the cluster is located to the left of the flask, and the shuttle assembly is located in the left and raised positions. Next, the shuttle assembly is lowered and the gripping mechanisms engage the sprue cup to secure the cluster relative to the tubes. Next, the shuttle assembly is raised and moved to the right position so that the shuttle assembly and cluster are below the batch hopper and above the flask. Next, the batch hopper, shuttle assembly and cluster are lowered so that the cluster and tubes are located within the flask. Next, the sliding door is moved to the open position so that sand flows from the batch hopper into the chamber, into the tubes 44 and 46, and from the lower ends of the tubes into the flask. The bolts 60 deflect sand around the runners. When the sand reaches the level of the lower ends of the tubes and supports the cluster, the gripping mechanisms are released, and the shuttle assembly is raised relative to the mold flask and to the cluster. The tubes are raised slowly so that the sand in all of the tubes is nearly stalled. As a result, the nearly stalled sand continuously fills the flask to the level of the lower ends of the tubes. Any difference in the surface level of the sand is caused by the angle of repose of the sand and the distance between the tubes. Pattern distortion is reduced because the sand level is substantially uniform throughout the mold flask, so that the forces inside and outside the patterns are substantially equal, and because the nearly stalled sand flow minimizes the kinetic energy and differential potential energy of the sand.

Various features of the invention are set forth in the following claims.

I claim:

1. An apparatus for surrounding a mold pattern with sand in a mold flask, said apparatus comprising a plurality of generally vertically extending tubes, means for securing the pattern to said tubes to form a tube and pattern assembly, means for causing relative movement of the assembly and the flask so that the assembly is located in the flask, and means for depositing sand through said tubes and into the flask.

2. An apparatus as set forth in claim 1 wherein said means for causing relative movement of the assembly and the flask includes means for moving the assembly relative to the flask.

3. An apparatus as set forth in claim 2 wherein said means for moving the assembly includes means for lowering the assembly into the flask.

4. An apparatus as set forth in claim 1 wherein said tubes have respective lower ends, and wherein said apparatus further comprises means for raising said lower ends of said tubes.

5. An apparatus as set forth in claim 1 and further comprising means for releasing said securing means, and means for raising said tubes relative to the flask and to the pattern.

6. An apparatus as set forth in claim 1 wherein the pattern includes a portion located beneath one of said tubes, and wherein said apparatus further comprises means for deflecting sand around the pattern portion.

7. An apparatus for surrounding a mold pattern cluster with sand in a mold flask, the cluster including a plurality of sleeve patterns, said apparatus comprising a plurality of generally vertically extending tubes having respective lower ends located substantially in a horizontal plane, means for supporting the cluster in the flask, means for supporting said tubes in and among the cluster so that each sleeve pattern has located therein a respective tube, and means for depositing sand through said tubes and into the flask.

8. An apparatus as set forth in claim 7 wherein said apparatus further comprises means for raising said lower ends of said tubes.

9. An apparatus as set forth in claim 7 and further comprising means for raising said tubes relating to the flask and to the cluster.

10. An apparatus as set forth in claim 7 wherein the cluster includes a portion located beneath one of said tubes, and wherein said apparatus further comprises means for deflecting sand around the cluster portion.

11. An apparatus for surrounding a mold pattern cluster with sand in a mold flask, the cluster including a plurality of sleeve patterns, said apparatus comprising a plurality of generally vertically extending tubes having respective lower ends located substantially in a horizontal plane, means for securing the cluster to said tubes to form a tube and cluster assembly, and for supporting said tubes in and among the cluster so that each sleeve pattern has located therein a respective tube, means for causing relative movement of the assembly and the flask so that the assembly is located in the flask, and means for depositing sand through said tubes and into the flask.

12. An apparatus as set forth in claim 11 wherein said means for causing relative movement of the assembly and the flask includes means for moving the assembly relative to the flask.

13. An apparatus as set forth in claim 12 wherein said means for moving the assembly includes means for lowering the assembly into the flask.

14. An apparatus as set forth in claim 11 wherein said apparatus further comprises means for raising said lower ends of said tubes.

15. An apparatus as set forth in claim 11 and further comprising means for releasing said securing means, and means for raising said tubes relative to the flask and to the pattern.

16. An apparatus as set forth in claim 11 wherein the cluster includes a portion located beneath one of said tubes, and wherein said apparatus further comprises means for deflecting sand around the cluster portion.

17. An apparatus for surrounding a mold pattern cluster with sand in a mold flask, the cluster including a plurality of sleeve patterns, said apparatus comprising a plurality of generally vertically extending tubes, means for supporting the cluster in the flask, means for supporting said tubes in and among the cluster so that each sleeve pattern has located therein a respective tube, and means for depositing sand through said tubes and into the flask.

18. An apparatus as set forth in claim 17 wherein said tubes have respective lower ends, and wherein said apparatus further comprises means for raising said lower ends of said tubes.

19. An apparatus as set forth in claim 17 and further comprising means for raising said tubes relating to the flask and to the cluster.

20. An apparatus as set forth in claim 17 wherein the cluster includes a portion located beneath one of said tubes, and wherein said apparatus further comprises means for deflecting sand around the cluster portion.

21. An apparatus for surrounding a mold pattern cluster with sand in a mold flask, the cluster including a plurality of sleeve patterns, said apparatus comprising a plurality of generally vertically extending tubes, means for securing the cluster to said tubes to form a tube and cluster assembly, and for supporting said tubes in and among the cluster so that each sleeve pattern has located therein a respective tube, means for causing relative movement of the assembly and the flask so that the assembly is located in the flask, and means for depositing sand through said tubes and into the flask.

22. An apparatus as set forth in claim 21 wherein said means for causing relative movement of the assembly and the flask includes means for moving the assembly relative to the flask.

23. An apparatus as set forth in claim 22 wherein said means for moving the assembly includes means for lowering the assembly into the flask.

24. An apparatus as set forth in claim 21 wherein said tubes have respective lower ends, and wherein said apparatus further comprises means for raising said lower ends of said tubes.

25. An apparatus as set forth in claim 21 and further comprising means for releasing said securing means, and means for raising said tubes relative to the flask and to the pattern.

26. An apparatus as set forth in claim 21 wherein the cluster includes a portion located beneath one of said tubes, and wherein said apparatus further comprises means for deflecting sand around the cluster portion.

* * * * *